US010273663B2

(12) United States Patent
Kunz

(10) Patent No.: US 10,273,663 B2
(45) Date of Patent: Apr. 30, 2019

(54) SHROUD COLLAR FOR EDGE PROTECTION OF A WORK TOOL

(71) Applicant: Caterpillar Inc., Peoria, IL (US)

(72) Inventor: Phillip John Kunz, Morton, IL (US)

(73) Assignee: Caterpillar Inc., Deerfield, IL (US)

( * ) Notice: Subject to any disclaimer, the term of this patent is extended or adjusted under 35 U.S.C. 154(b) by 38 days.

(21) Appl. No.: 15/176,391

(22) Filed: Jun. 8, 2016

(65) Prior Publication Data

US 2017/0058491 A1 Mar. 2, 2017

Related U.S. Application Data

(60) Provisional application No. 62/208,942, filed on Aug. 24, 2015.

(51) Int. Cl.
*E02F 9/28* (2006.01)
*E02F 3/40* (2006.01)

(52) U.S. Cl.
CPC ..... *E02F 9/2833* (2013.01); *E02F 9/2858* (2013.01); *E02F 9/2883* (2013.01); *E02F 3/40* (2013.01)

(58) Field of Classification Search
CPC ..... E02F 9/28; E02F 9/2858; E02F 9/2883
See application file for complete search history.

(56) References Cited

U.S. PATENT DOCUMENTS 3,774,324 A * 11/1973 Lafond ..... E02F 9/2841 172/713
3,851,413 A * 12/1974 Lukavich ..... E02F 9/2816 37/450
5,210,965 A * 5/1993 Funk, Sr. ..... E02F 9/285 172/713
5,452,529 A * 9/1995 Neuenfeldt ..... E02F 9/2825 37/395
9,359,745 B2 * 6/2016 Serrurier ..... E02F 3/40
2008/0005939 A1 * 1/2008 Launder ..... E02F 9/28 37/452
2013/0164106 A1 * 6/2013 Clause ..... E02F 3/30 414/722
2015/0101218 A1 4/2015 Surrurier et al.
2017/0284073 A1 * 10/2017 Kunz ..... E02F 9/2883

FOREIGN PATENT DOCUMENTS

WO 0020696 4/2000
WO 2012142667 10/2012
WO WO-2017196518 A1 * 11/2017 ..... E02F 9/24
WO WO-2017196521 A1 * 11/2017 ..... E02F 9/2825

* cited by examiner

*Primary Examiner* — Matthew D. Troutman

(74) *Attorney, Agent, or Firm* — Finnegan, Henderson, Farabow, Garrett & Dunner, LLP

(57) ABSTRACT

A shroud collar for protecting an edge of a work tool is disclosed. The shroud collar may have a first side plate. The first side plate may have a first lower leg and a first upper leg spaced apart from the first lower leg. The shroud collar may have a second side plate spaced apart from the first plate. The second side plate may have a second lower leg and a second upper leg spaced apart from the second lower leg. The shroud collar may also have an upper crossbar connected to the first side plate and the second side plate. The upper crossbar may be configured to be connectable to the work tool.

12 Claims, 4 Drawing Sheets

SHROUD COLLAR FOR EDGE PROTECTION OF A WORK TOOL

RELATED APPLICATION

This application is based on and claims benefit of priority of U.S. Provisional Patent Application No. 62/208,942, filed Aug. 24, 2015, which is incorporated herein by reference.

TECHNICAL FIELD

The present disclosure relates generally to a shroud collar and, more particularly, to a shroud collar for edge protection of a work tool.

BACKGROUND

Earth-working machines, such as hydraulic excavators, cable shovels, wheel loaders, and front shovels, include ground engaging work tools that dig into and/or move a variety of earthen materials. These work tools often have one or more cutting tools or tooth assemblies mounted to an edge of the work tool, for example, to a lip of a bucket. The exposed portions of the work tool edge between adjacent tooth assemblies come into contact with the ground or earthen materials and are subjected to extreme abrasion and impacts that cause them to wear. To prolong the useful life of the work tools, shrouds are attached to the work tools between adjacent tooth assemblies to protect the exposed portions of the work tool edge.

Although installation of the shrouds still leaves gaps between the shrouds and the adjacent tooth assemblies, the gaps are relatively small, preventing the earthen material from impacting any remaining exposed portions of the work tool edge. When a non-standard width work tool (e.g. bucket) is used, however, the width of the best fitting shroud may not be sufficient to cover the entire gap between adjacent tooth assemblies. As a result, earthen materials may still contact the exposed edge of the work tool between the shroud and the adjacent tooth assemblies, causing significant abrasion and wear of the exposed edge. Therefore, it may be necessary to further shield the exposed portions of the edge between the shroud and the adjacent tooth assemblies to protect the exposed edge of the work tool.

U.S. Patent Application Publication No. 2015/0101218 of Serrurier et al., published on Apr. 16, 2015 ("the '218 publication"), discloses an edge protection system consisting of edge protection segments for a ground engaging implement. In particular, the '218 publication discloses an edge protection segment that has a wedge portion and two legs that straddle the edge of a bucket. The wedge portion of the disclosed edge protection segment of the '218 publication abuts against the exposed edge of the bucket. The '218 publication also discloses that each edge protection segment has interlocking projections on one side and interlocking depressions on an opposite side. The '218 publication explains that two or more edge protection segments can be placed side-by-side with mating interlocking projections and depressions to cover a larger portion of the exposed edge between adjacent tooth assemblies on the bucket. The '218 publication further discloses that the edge protection segments are bonded to the implement.

Although the '218 publication discloses an edge protection system, the disclosed edge protection system may still be improved. For example, the edge protection segments of the '218 publication have different widths but the same lengths, making it difficult for the segments to conform to an edge that may not be straight along the width of the implement. Further, because the edge protection segments of the '218 publication are bonded to the implement, they may not be reusable. Further still, because the edge protection segments are bonded to the implement, it may be more difficult to attach or remove the edge protection segments at a work site.

The shroud collar of the present disclosure solves one or more of the problems set forth above and/or other problems of the prior art.

SUMMARY

In one aspect, the present disclosure is directed to a shroud collar for protecting an edge of a work tool. The shroud collar may include a first side plate. The first side plate may include a first lower leg and a first upper leg spaced apart from the first lower leg. The shroud collar may include a second side plate spaced apart from the first plate. The second side plate may include a second lower leg and a second upper leg spaced apart from the second lower leg. The shroud collar may also include an upper crossbar connected to the first side plate and the second side plate. The upper crossbar may be configured to be connectable to the work tool.

In another aspect, the present disclosure is directed to a side plate for a shroud collar. The side plate may include a lower leg. Further, the side plate may include an upper leg spaced apart from the lower leg. The side plate may also include a wedge member extending from a first end to a second end. The wedge member may be attached to the upper leg at the first end. The wedge member may be inclined relative to the upper leg. The side plate may also include an end member attached to the lower leg and to the wedge member. The end member may include an inner surface configured to abut an edge of a work tool. The end member may also include an outer surface disposed generally parallel to the inner surface.

In yet another aspect, the present disclosure is directed to a work tool. The work tool may include a first side wall and a second side wall spaced apart from the first side wall. The work tool may also include a primary wall including an edge extending from the first side wall to the second side wall. The work tool may further include a first tooth assembly attached to the edge and a second tooth assembly attached to the edge. The second tooth assembly may be spaced apart from the first tooth assembly. The work tool may include a shroud boss disposed between the first tooth assembly and the second tooth assembly. The work tool may also include a shroud attached to the shroud boss. The shroud may be separated from the first tooth assembly by a first gap. The shroud may also be separated from the second tooth assembly by a second gap. The work tool may include a shroud collar disposed about the shroud. The shroud collar may include a first side plate disposed in the first gap. The shroud collar may also include a second side plate spaced apart from the first plate. The second plate may be disposed in the second gap. The shroud collar may further include an upper crossbar extending between the first side plate and the second side plate. The upper cross bar may be connected to the first side plate, the second side plate, and the shroud boss.

DETAILED DESCRIPTION

Figure 1:
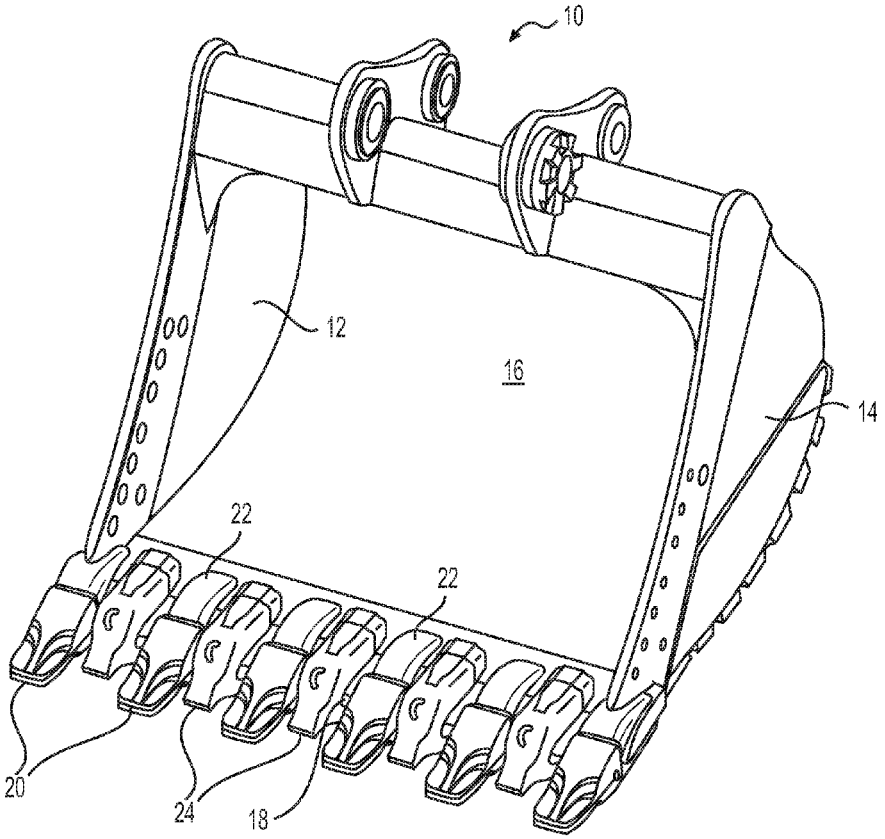
FIG. 1 is an illustration of an exemplary work tool.

FIG. 1 illustrates an exemplary work tool 10 for a machine (not shown). Work tool 10 may embody any device used to perform a task assigned to the machine. For example, work tool 10 may be a bucket (shown in FIG. 1), a blade, a shovel, a crusher, a grapple, a ripper, or any other material moving device known in the art. Work tool 10 may include side walls 12, 14, and a primary wall 16, which may form a bottom of work tool 10. Primary wall 16 may extend from side wall 12 to side wall 14. Primary wall 16 of work tool 10 may also include an edge 18 extending between side walls 12, 14. Edge 18 may be detachable from work tool 10 or it may be a fixed component of work tool 10.

Work tool 10 may include a plurality of tooth assemblies 20 attached to edge 18 via adapters 22. Each tooth assembly 20 may be detachably attached to an adapter 22, which may be fixedly attached to edge 18. Work tool 10 may include a plurality of shrouds 24 (or wear members) disposed between adjacent adapters 22 or adjacent tool assemblies 20. Each shroud 24 may cover a portion of edge 18 disposed between adjacent adapters 22. Shroud 24 may be configured to protect edge 18 from abrasion and wear by reducing or preventing contact of an exposed portion of edge 18 with earthen materials.

Figure 2:
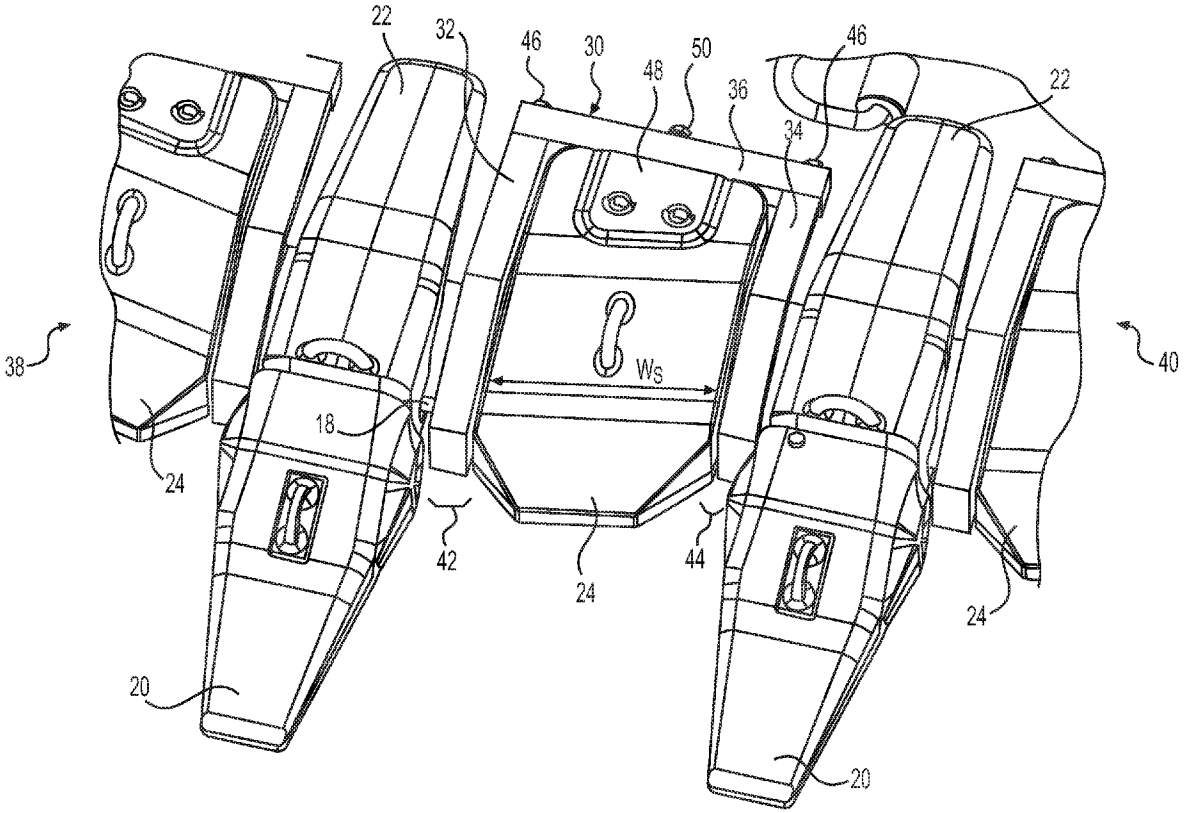
FIG. 2 is an illustration of an exemplary shroud collar attached to the work tool of FIG. 1.

FIG. 2 illustrates an exemplary shroud collar 30 attached to work tool 10. Shroud collar 30 may be disposed about shroud 24 on work tool 10. Shroud collar 30 may include first side plate 32, second side plate 34, upper crossbar 36, and lower crossbar 52 (not shown in FIG. 2). First and second side plates 32, 34 may be disposed on either side of shroud 24, which may have a width "$W_s$." For example, as illustrated in FIG. 2, first side plate 32 may be disposed on first side 38 of shroud 24, between shroud 24 and tooth assembly 20. Second side plate 34 may be disposed on second side 40 of shroud 24, opposite first side 38, and between shroud 24 and tooth assembly 20.

First side plate 32 may be configured to occupy first gap 42 between shroud 24 and tooth assembly 20 to cover and protect a portion of edge 18 disposed in first gap 42. Likewise, second side plate 34 may be configured to occupy second gap 44 between shroud 24 and tooth assembly 20 to cover and protect a portion of edge 18 disposed in second gap 44. First and second side plates 32, 34 may be disposed generally parallel to each other. It is contemplated, however, that first and second side plates 32, 34 may be inclined relative to each other. Upper crossbar 36 may be attached to first side plate 32 and second side plate 34 via one or more fasteners 46. Upper crossbar 36 may also be attached to shroud boss 48 via one or more fasteners 50. Shroud boss 48 may be attached to edge 18. In one exemplary embodiment, shroud boss 48 may be welded, brazed, or bonded using any other method of attachment to edge 18. Shroud 24 may be detachably attached to shroud boss 48.

Figure 3:
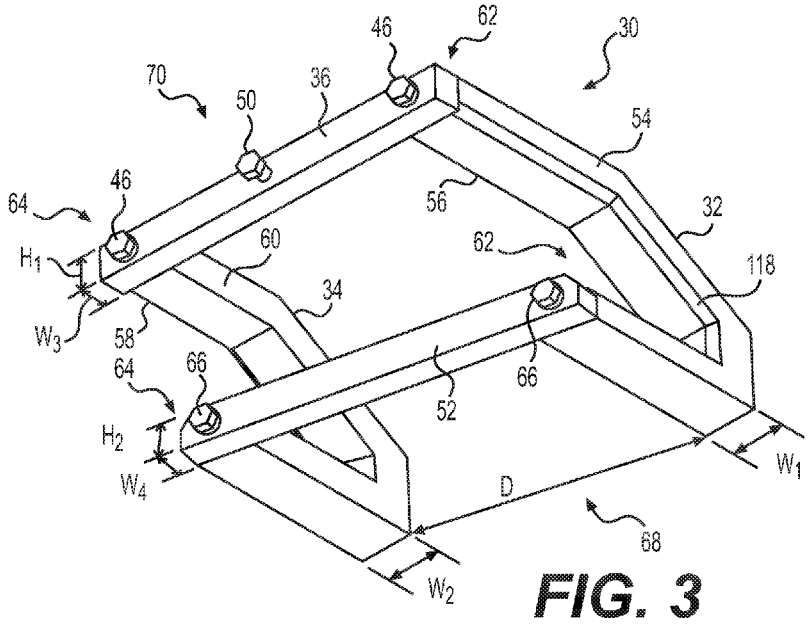
FIG. 3 is a rear-side perspective view of an exemplary shroud collar for the work tool of FIG. 1.

FIG. 3 illustrates a perspective view of an exemplary disclosed shroud collar 30. As discussed above and as further illustrated in FIG. 3, shroud collar may include first side plate 32, second side plate 34, upper crossbar 36, and lower crossbar 52. As used in this disclosure, the terms "upper" and "lower" may distinguish between two structural members and may not indicate relative positions of the respective members. Thus, for example, lower crossbar 52 may be disposed at a gravitationally higher position than upper crossbar 36 and vice-versa. First side plate 32 may have a first outer side 54 and a first inner side 56 disposed opposite first outer side 54. Likewise, second side plate 34 may have a second outer side 58 and a second inner side 60 disposed opposite second outer side 58. First outer side 54 may be generally parallel to first inner side 56. Likewise, second outer side 58 may be generally parallel to second inner side 60. First inner side 56 of first side plate 32 may be disposed opposite to and spaced apart from second inner side 60 of second side plate 34. A distance "D" between first inner side 56 of first side plate 32 and second inner side 60 of second side plate 34 may be larger than a width $W_s$ (FIG. 2) of shroud 24. First side plate 32 may have a width "$W_1$," extending from first outer side 54 to first inner side 56. Second side plate 34 may have a width "$W_2$," extending from second outer side 58 to second inner side 60. It is contemplated that widths $W_1$, $W_2$ may be equal or unequal.

Upper and lower crossbars 36, 52 may each extend from first end 62 adjacent first side plate 32 to second end 64 adjacent second side plate 34. Upper crossbar 36 may have a height "$H_1$" and a width "$W_3$," and lower crossbar 52 may have a height "$H_2$" and a width "$W_4$." Heights $H_1$ and $H_2$ and widths $W_3$ and $W_4$ may be equal or unequal. Moreover, widths $W_3$ and $W_4$ may be the same as or different from one or more of widths $W_1$, $W_2$. Upper and lower crossbars 36, 52 may be attached to first and second side plates 32, 34 such that first side plate 32 and second side plate 34 may be spaced apart from each other at distance "D."

As illustrated in FIG. 3, upper crossbar 36 may be attached to first and second side plates 32, 34 via fasteners 46. Upper crossbar 36 may include holes (not shown) adjacent first end 62 and second end 64. Fasteners 46 may pass through the holes adjacent first end 62 and second end 64 and threadably engage with first side plate 32 and second side plate 34, respectively, to attach upper crossbar to first and second side plates 32, 34. Although only one fastener 46 is illustrated adjacent each of first and second ends 62, 64 of upper crossbar 36, it is contemplated that upper crossbar 36 may be attached at each of first and second ends 62, 64 using more than one fastener 46. Using more than one fastener 46 at each of first and second ends 62, 64 may help ensure that upper crossbar 36 does not rotate relative to first and second side plates 32, 34. In one exemplary embodiment, upper crossbar 36 may include projections (not shown) at each of first and second ends 62, 64, which may mate with corresponding depressions (not shown) in first and second side plates 32, 34, respectively. The interlocking projections and depressions together with one or more fasteners 46 at each of first and second ends 62, 64 may help ensure that upper crossbar 36 cannot rotate relative to first and second side plates 32, 34.

As also illustrated in FIG. 3, lower crossbar 52 may be attached to first and second side plates 32, 34 via fasteners 66. Lower crossbar 52 may include holes (not shown) adjacent first end 62 and second end 64. Fasteners 66 may pass through the holes adjacent first end 62 and second end 64 and threadably engage with first side plate 32 and second side plate 34, respectively, to attach lower crossbar 52 to first and second side plates 32, 34. Although only one fastener 66 is illustrated adjacent each of first and second ends 62, 64 of lower crossbar 52, it is contemplated that lower crossbar 52 may be attached at each of first and second ends 62, 64 using more than one fastener 66. Using more than one fastener 66 at each of first and second ends 62, 64 may help ensure that lower crossbar 52 does not rotate relative to first and second side plates 32, 34. In one exemplary embodiment, like upper crossbar 36, lower crossbar 52 may include projections (not shown) at each of first and second ends 62, 64, which may mate with corresponding depressions (not shown) in first and second side plates 32, 34, respectively. The interlocking projections and depressions together with one or more fasteners 66 at each of first and second ends 62, 64 may help ensure that lower crossbar 52 does not rotate relative to first and second side plates 32, 34. It is also contemplated that lower crossbar 52 may be fixedly attached to first and second side plates 32, 34 via welded joints at first and second ends 62, 64, respectively.

Figure 4:
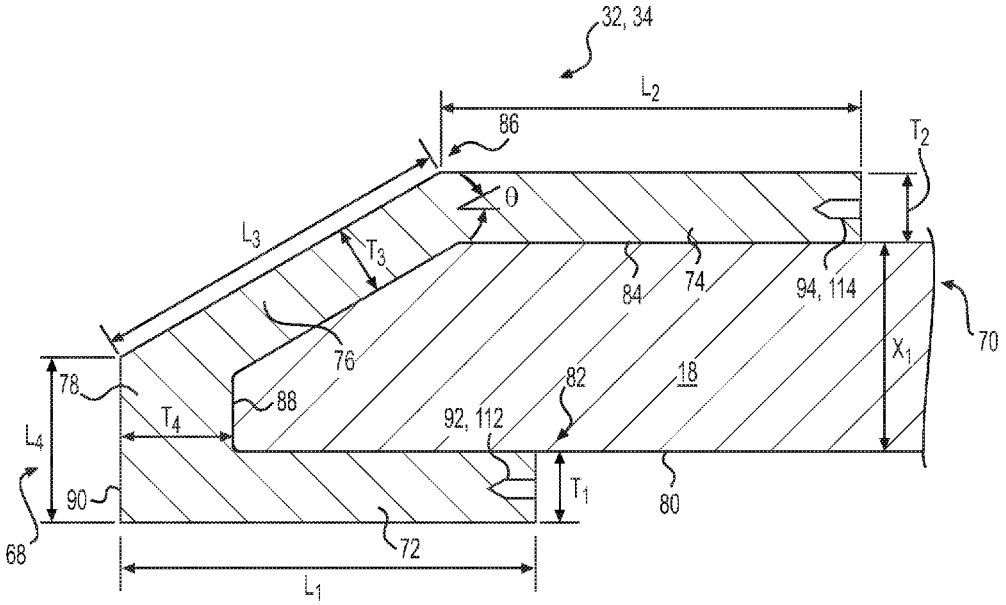
FIG. 4 is a cross-sectional view of an exemplary side plate for the shroud collar of FIG. 3.

FIG. 4 illustrates a cross-sectional view of an exemplary disclosed first side plate 32 attached to edge 18. As illustrated in FIG. 4, first side plate 32 may extend from collar front end 68 to collar rear end 70. First side plate 32 may include first lower leg 72, first upper leg 74, first wedge member 76, and first end member 78. First lower leg 72, first upper leg 74, first wedge member 76, and first end member 78 may have a generally square or rectangular cross-section in a plane orthogonal to first side plate 32. It is contemplated, however, that first lower leg 72, first upper leg 74, first wedge member 76, and first end member 78 may have a circular, elliptical, polygonal, or any other type of cross-section known in the art. First side plate 32 may be manufactured by cutting sheet metal stock so that first lower leg 72, first upper leg 74, first wedge member 76, and first end member 78 form an integral structure of first side plate 32. It is contemplated, however, that first side plate 32 may be formed by casting, forging, or any other manufacturing process known in the art. It is further contemplated, that first lower leg 72, first upper leg 74, first wedge member 76, and first end member 78 may each be manufactured separately by cutting sheet metal stock, forging, casting, etc. and may be joined to form first side plate 32 using welding, brazing, or any other manufacturing processes known in the art.

First lower leg 72 may be disposed on first side 80 of edge 18. First lower leg 72 may extend from adjacent collar front end 68 to first lower leg distal end 82 disposed between collar front end 68 and collar rear end 70. First lower leg 72 may have a length "$L_1$" and a thickness "$T_1$." First upper leg 74 may be disposed on second side 84 of edge 18. Second side 84 of edge 18 may be disposed opposite first side 80 of edge 18. First upper leg 74 may be spaced apart from first lower leg 72 by a distance "$X_1$." In one exemplary embodiment, distance $X_1$ may be about equal to a thickness of edge 18 of work tool 10. First upper leg 74 may extend from adjacent collar rear end 70 to first upper leg distal end 86 disposed between collar front end 68 and collar rear end 70. First upper leg 74 may be disposed generally parallel to first lower leg 72. It is contemplated, however, that in some exemplary embodiments, first upper leg 74 may be inclined relative to first lower leg 72. In one exemplary embodiment as illustrated in FIG. 4, first upper leg distal end 86 may be disposed between collar front end 68 and first lower leg distal end 82. First upper leg 74 may have a length "$L_2$" and a thickness "$T_2$."

First wedge member 76 may extend from first upper leg distal end 86 to collar front end 68. First wedge member 76 may be attached to first upper leg 74 adjacent first upper leg distal end 86. First wedge member 76 may be inclined relative to first lower leg 72 and first upper leg 74. For example, first wedge member 76 may be inclined at an angle "θ" relative to first upper leg 74. In one exemplary embodiment angle θ may range from about 0° to about 89°. As used in this disclosure, the terms "about" and "generally" indicate typical manufacturing tolerances and dimensional rounding. Thus, for example, the words about and generally may indicate an angular variation of ±1°. First wedge member 76 may have a length "$L_3$" and a thickness "$T_3$."

First end member 78 may be disposed adjacent collar front end 68. First end member 78 may extend from first lower leg 72 to first wedge member 76 and may be attached to first lower leg 72 and first wedge member 76. In one exemplary embodiment as illustrated in FIG. 4, first end member 78 may be disposed generally orthogonal to first lower leg 72. First end member 78 may have a length "$L_4$" and a thickness "$T_4$." First end member 78 may have an first inner surface 88 extending from first outer side 54 to first inner side 56. First inner surface 88 may abut against edge 18 of work tool 10 when first side plate 32 is attached to work tool 10. First end member 78 may have a first outer surface 90 extending from first outer side 54 to first inner side 56. First outer surface 90 may be spaced apart from and disposed generally parallel to first inner surface 88. It is contemplated, however, that first outer surface 90 may be inclined relative to first inner surface 88. Length $L_4$ of first end member 78 may be smaller than lengths $L_1$, $L_2$, and $L_3$ of first lower leg 72, first upper leg 74, and first wedge member 76, respectively. Lengths $L_1$, $L_2$, and $L_3$ of first lower leg 72, first upper leg 74, and first wedge member 76 may be equal or unequal. Likewise, thicknesses $T_1$, $T_2$, $T_3$, and $T_4$ of first lower leg 72, first upper leg 74, first wedge member 76, and first end member 78, respectively, may be equal or unequal.

First lower leg 72 may include a first hole 92 disposed adjacent first lower leg distal end 82. First hole 92 may extend lengthwise into first lower leg 72 from adjacent first lower leg distal end 82 towards collar front end 68. First hole 92 may be tapped and may be configured to threadably receive fastener 66. Although FIG. 4 illustrates only one first hole 92, it is contemplated that first lower leg 72 may have any number of first holes 92 disposed adjacent first lower leg distal end 82. First upper leg 74 may include a second hole 94 disposed adjacent collar rear end 70. Second hole 94 may extend lengthwise into first upper leg 74 from adjacent collar rear end 70 towards collar front end 68. Second hole 94 may be tapped and may be configured to threadably receive fastener 46. Although FIG. 4 illustrates only one second hole 94, it is contemplated that first upper leg 74 may have any number of second holes 94 disposed adjacent collar rear end 70. Second side plate 34 may have a similar structure and features as those discussed above with respect to first side plate 32. Further, second side plate 34 may be manufactured using fabrication techniques similar to those discussed above with respect to first side plate 32.

Figure 5:
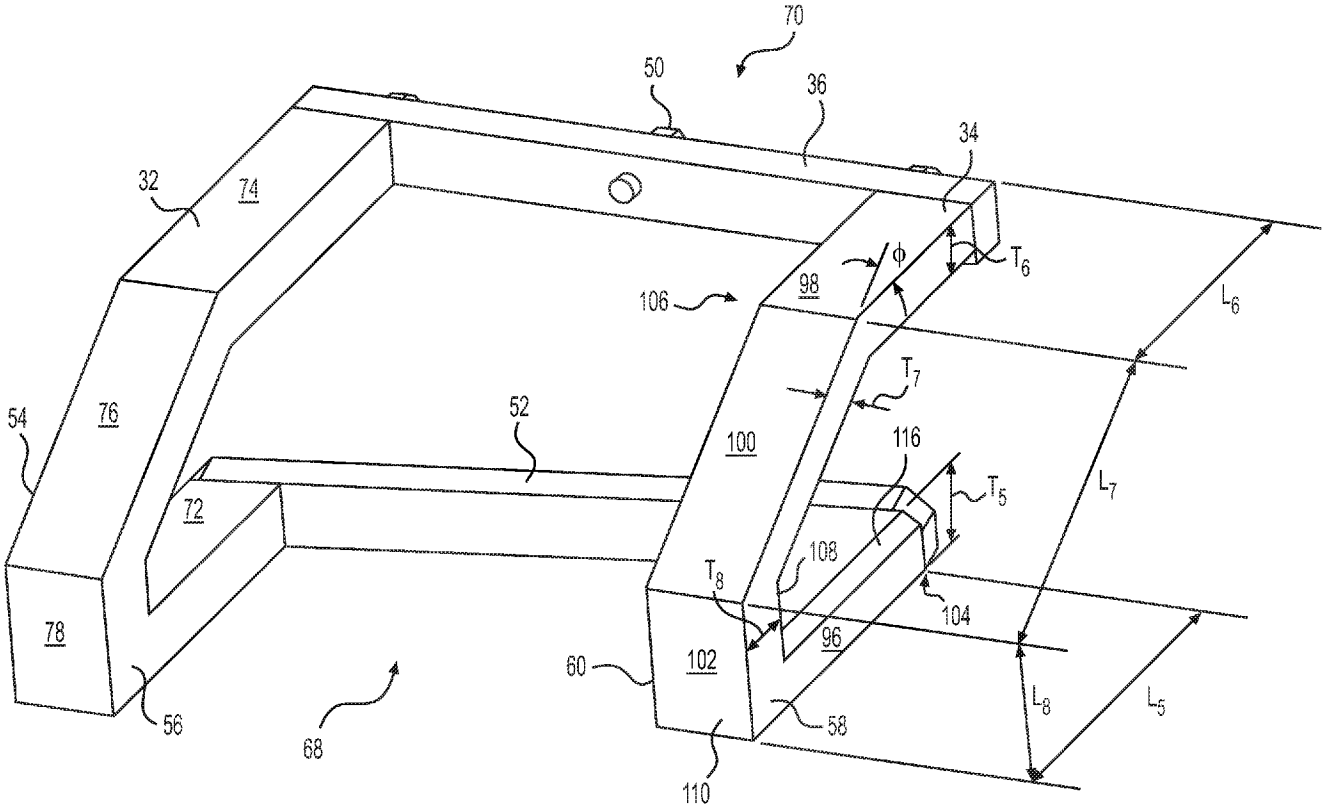
FIG. 5 is a front-side perspective view of the exemplary shroud collar for the work tool of FIG. 1.

FIG. 5 illustrates a front perspective view of an exemplary disclosed shroud collar 30. As discussed above and as further illustrated in FIG. 5, first side plate 32 of shroud collar may include first lower leg 72, first upper leg 74, first wedge member 76, and first end member 78. Likewise second side plate 34 may include second lower leg 96, second upper leg 98, second wedge member 100, and second end member 102. Second lower leg 96 may extend from adjacent collar front end 68 to second lower leg distal end 104 disposed between collar front end 68 and collar rear end 70. Like first lower leg 72, second lower leg 96 may be disposed on first side 80 of edge 18 (FIG. 4). Second lower leg 96 may have a length "$L_5$" and a thickness "$T_6$." Second upper leg 98, like first upper leg 74, may be disposed on second side 84 of edge 18 (FIG. 4). Second upper leg 98 may be spaced apart from second lower leg 96 by a distance "$X_2$." In one exemplary embodiment, distance $X_2$ may be about equal to a thickness of edge 18 of work tool 10. Distance $X_2$ may be the same as or different from distance $X_1$ (FIG. 4). Second upper leg 98 may extend from adjacent collar rear end 70 to second upper leg distal end 106 disposed between collar front end 68 and collar rear end 70. Second upper leg 98 may be disposed generally parallel to second lower leg 96. It is contemplated, however, that in some exemplary embodiments, second upper leg 98 may be inclined relative to second lower leg 96. In one exemplary embodiment, second upper leg distal end 106 may be disposed between collar front end 68 and second lower leg distal end 104. Second upper leg 98 may have a length "$L_6$" and a thickness "$T_6$."

Second wedge member 100 may extend from second upper leg distal end 106 to collar front end 68. Second wedge member 100 may be attached to second upper leg 98 adjacent second upper leg distal end 106. Second wedge member 100 may be inclined relative to second lower leg 96 and second upper leg 98. For example, second wedge member 100 may be inclined at an angle "ϕ" relative to second upper leg 98. In one exemplary embodiment angle ϕ may be the same as or different from angle θ (FIG. 4). In another exemplary embodiment, angle ϕ may range from about 0° to about 89°. Second wedge member 100 may have a length "$L_7$" and a thickness "$T_7$."

Second end member 102 may be disposed at collar front end 68. Second end member 102 may extend from second lower leg 96 to second wedge member 100 and may be attached to second lower leg 96 and second wedge member 100. In one exemplary embodiment as illustrated in FIG. 5, second end member 102 may be disposed generally orthogonal to second lower leg 96. Second end member 102 may have a length "$L_8$" and a thickness "$T_8$." Second end member 102 may have an second inner surface 108 extending from second outer side 58 to second inner side 60. Second inner surface 108 may abut against edge 18 of work tool 10 when second side plate 34 is attached to work tool 10. Second end member 102 may have a second outer surface 110 extending from second outer side 58 to second inner side 60. Second outer surface 110 may be spaced apart from and disposed generally parallel to second inner surface 108. It is contemplated, however, that second outer surface 110 may be inclined relative to second inner surface 108. Length $L_8$ of second end member 102 may be smaller than lengths $L_5$, $L_6$, and $L_7$ of second lower leg 96, second upper leg 98, and second wedge member 100, respectively. Lengths $L_5$, $L_6$, and $L_7$ of second lower leg 96, second upper leg 98, and second wedge member 100 may be equal or unequal. Likewise, thicknesses $T_5$, $T_6$, $T_7$, and $T_8$ of second lower leg 96, second upper leg 98, second wedge member 100, and second end member 102, respectively, may be equal or unequal. It is also contemplated that lengths $L_1$, $L_2$, $L_3$, $L_5$, $L_6$, and $L_7$ may be equal or unequal, and length $L_4$ may be equal or unequal to length $L_8$. Likewise, thicknesses $T_1$, $T_2$, $T_3$, $T_4$, $T_5$, $T_6$, $T_7$, and $T_8$ may be equal or unequal. Like first lower leg 72, second lower leg 96 may include third hole 112 (FIG. 4), which be similar to first hole 92. Further, like first upper leg 74, second upper leg 98 may include fourth hole 114 (FIG. 4), which may be similar to second hole 94.

Second outer side 58 of second side plate 34 may include chamfer 116. As illustrated in FIG. 5, chamfer 116 may extend along a length of each of second lower leg 96, second upper leg 98, second wedge member 100, and second end member 102 on second outer side 58. Likewise, first outer side 54 of first side plate 32 may also include chamfer 118 (FIG. 3). Thus, chamfer 118 may extend along a length of each of first lower leg 72, first upper leg 74, first wedge member 76, and first end member 78 on first outer side 54.

Industrial Applicability

The disclosed shroud collar may be used with various earth-working machines, such as hydraulic excavators, cable shovels, wheel loaders, front shovels, draglines, and bulldozers. Specifically, the shroud collar may be connected to work tools of these machines to help protect the work tool edges against wear particularly in the gaps between shrouds and tooth assemblies on the work tools. Assembly of shroud collar 30 to work tool 10 will now be described in detail.

To connect shroud collar 30 to edge 18 of work tool 10, a service technician may first select first and second side plates 32, 34. Lengths $L_1$, $L_2$, $L_3$, $L_4$, $L_5$, $L_6$, $L_7$, and $L_8$, and thicknesses $T_1$, $T_2$, $T_3$, $T_4$, $T_5$, $T_6$, $T_7$, and $T_8$ of first and second side plates 32, 34 may be selected so that when first and second inner surfaces 88, 108 abut against edge 18 of work tool 10, first and second side plates 32, 34 may conform to a shape of edge 18. The service technician may attach lower crossbar 52 to first and second side plates 32, 34. For example, the technician may insert fastener 66 through a hole disposed adjacent first end 62 in lower crossbar 52 and further insert the fastener into first hole 92. Fastener 66 may threadably engage with threads in first hole 92 to help attach lower crossbar 52 to first side plate 32. Likewise, the technician may insert fastener 66 through a hole disposed adjacent second end 64 in lower crossbar 52 and further insert the fastener into third hole 112. Fastener 66 may threadably engage with threads in third hole 112 to help attach lower crossbar 52 to second side plate 34. The service technician may weld lower crossbar 52 to first and second side plates 32, 34 adjacent first and second ends 62, 64, respectively, to help ensure that there is no relative rotation between first and second side plates 32, 34, and lower crossbar 52.

The service technician may install the first and second plates 32 with the lower crossbar 52 on work tool 10 so that first and second side plates 32, 34 may be disposed on either side of shroud 24. In particular, the service technician may orient first side plate 32 such that first inner side 56 may be disposed nearer to shroud boss 48 as compared to first outer side 54, first lower leg 72 may be disposed on first side 80 of edge 18, and first upper leg 74 may be disposed on second side 84 of edge 18. Similarly, the service technician may orient second side plate 34 such that second inner side 60 may be disposed nearer to shroud boss 48 compared to second outer side 58, second lower leg 96 may be disposed on first side 80 of edge 18, and second upper leg 98 may be disposed on second side 84 of edge 18.

The service technician may then install upper crossbar 36. To install upper crossbar 36, the technician may insert fastener 46 through a hole disposed adjacent first end 62 in upper crossbar 36 and further insert fastener 46 into second hole 94. Fastener 46 may threadably engage with threads in second hole 94 to help attach upper crossbar 36 to first side plate 32. Likewise, the technician may insert fastener 46 through a hole disposed adjacent second end 64 in upper crossbar 36 and further insert the fastener into fourth hole 114. Fastener 46 may threadably engage with threads in fourth hole 114 to help attach upper crossbar 36 to second side plate 34. The service technician may also attach upper crossbar 36 to shroud boss 48 using one or more fasteners 50. Turning fasteners 50 may help pull shroud collar 30 onto edge 18 of work tool 10 such that first and second inner surfaces 88, 108 may abut against edge 18.

The disclosed shroud collar 30 may help prevent earthen materials from entering first and second gaps 42, 44 and impacting edge 18 of work tool 10 disposed within first and second gaps 42, 44. In particular, the earthen materials may impact first and second plates 32, 34 instead of edge 18, helping to reduce or eliminate wear of edge 18 within first and second gaps 42, 44. The disclosed shroud collar 30 may also allow a service technician to customize shroud collar 30 for each set of first and second gaps 42, 44, by selecting first and second plates having different lengths $L_1$, $L_z$, $L_3$, $L_4$, $L_5$, $L_6$, $L_7$, and $L_8$, thicknesses $T_1$, $T_z$, $T_3$, $T_4$, $T_5$, $T_6$, $T_7$, and $T_8$, and widths $W_1$, $W_2$. By selecting first and second plates having different lengths $L_1$, $L_2$, $L_3$, $L_4$, $L_5$, $L_6$, $L_7$, and $L_8$, the service technician may be able to select first and second side plates 32, 34 that may conform to a profiled edge 18 of work tool 10. Further, the disclosed shroud collar 30 may be reusable and replaceable. For example, because upper and lower crossbars 36, 52 may be detachably connectable to first and second side plates 32, 34, via fasteners 46, 66, and because upper crossbar may be detachably connectable to shroud boss 48 via fasteners 50, one or more of first and second plates 32, 34, upper crossbar 36, and/or lower crossbar 52 may be individually repaired and/or replaced in shroud collar 30.

It will be apparent to those skilled in the art that various modifications and variations can be made to the disclosed shroud collar. Other embodiments will be apparent to those skilled in the art from consideration of the specification and practice of the disclosed shroud collar. It is intended that the specification and examples be considered as exemplary only, with a true scope being indicated by the following claims and their equivalents.

What is claimed is:

1. A shroud collar for protecting an edge of a work tool, the shroud collar comprising:

a first side plate including a first lower leg and a first upper leg spaced apart from the first lower leg;

a second side plate separated from the first side plate by a gap, the second side plate including a second lower leg and a second upper leg spaced apart from the second lower leg, the first and second side plates extending between a collar front end and a collar rear end; and an upper crossbar connected to the first side plate and the second side plate adjacent the collar rear end, the upper crossbar configured to be connectable to the work tool.

2. The shroud collar of claim 1, further including a lower crossbar connected to the first side plate and the second side plate.

3. The shroud collar of claim 2, wherein the lower crossbar is connected to the first side plate and the second side plate via welded joints.

4. The shroud collar of claim 2, wherein the lower crossbar is connected to the first side plate and the second side plate via fasteners.

5. The shroud collar of claim 4, further including:

a first hole disposed in the first lower leg;

a second hole disposed in the first upper leg;

a third hole disposed in the second lower leg;

a fourth hole disposed in the second upper leg; and a plurality of fasteners threadably engaging with the first hole, the second hole, the third hole, and the fourth hole to attach the upper crossbar and the lower crossbar to the first side plate and the second side plate.

6. The shroud collar of claim 1, wherein the first side plate has a first width and the second side plate has a second width different from the first width.

7. The shroud collar of claim 1, wherein the first upper leg has a first thickness and the second upper leg has a second thickness different from the first thickness.

8. The shroud collar of claim 1, wherein the first upper leg has a first length and the second upper leg has a second length different from the first length.

9. The shroud collar of claim 1, wherein:

the first side plate has a first inner side and a first outer side disposed opposite the first inner side, the first outer side having a first chamfer;

the second side plate has a second inner side and a second outer side disposed opposite the second inner side, the second outer side having a second chamfer; and the first side plate and the second side plate are arranged such that the first inner side is disposed generally parallel to and opposite the second inner side.

10. The shroud collar of claim 1, wherein the first side plate extends from a collar front end to a collar rear end;

the second side plate extends from the collar front end to the collar rear end;

the upper crossbar is disposed adjacent the collar rear end and extends from a first end disposed adjacent the first upper leg to a second end disposed adjacent the second upper leg, and the upper crossbar is attached to the first upper leg at the first end and to the second upper leg at the second end.

11. A work tool, comprising:

a first side wall;

a second side wall spaced apart from the first side wall;

a primary wall including an edge extending from the first side wall to the second side wall;

a first tooth assembly attached to the edge;

a second tooth assembly attached to the edge, the second tooth assembly being spaced apart from the first tooth assembly;

a shroud boss disposed between the first tooth assembly and the second tooth assembly;

a shroud attached to the shroud boss, the shroud being separated from the first tooth assembly by a first gap, the shroud being separated from the second tooth assembly by a second gap; and a shroud collar disposed about the shroud, the shroud collar including:

a first side plate disposed in the first gap, the first side plate including a first lower leg and a first upper leg spaced apart from the first lower leg;

a second side plate separated from the first side plate by a gap, the second side plate disposed in the second gap, the second side plate including a second lower leg and a second upper leg spaced apart from the second lower leg, the first and second side plates extending between a collar front end and a collar rear end; and an upper crossbar connected to the first side plate and the second side plate adjacent the collar rear end, the upper crossbar being connected to the first side plate, the second side plate, and the shroud boss.

12. The work tool of claim 11, further including a lower crossbar extending from the first side plate to the second side plate, the lower crossbar being attached to the first lower leg and the second lower leg.

* * * * *